US012696924B2

(12) United States Patent
Natali et al.

(10) Patent No.: US 12,696,924 B2
(45) Date of Patent: Aug. 4, 2026

(54) METHOD FOR CHECKING AN AEROSOL-GENERATING ARTICLE FOR MANUFACTURING DEFECTS

(71) Applicant: PHILIP MORRIS PRODUCTS S.A., Neuchatel (CH)

(72) Inventors: Luca Natali, Milan (IT); Matteo Balboni, Milan (IT)

(73) Assignee: Philip Morris Products S.A., Neuchatel (CH)

( * ) Notice: Subject to any disclaimer, the term of this patent is extended or adjusted under 35 U.S.C. 154(b) by 453 days.

(21) Appl. No.: 18/286,155

(22) PCT Filed: Apr. 7, 2022

(86) PCT No.: PCT/EP2022/059185

§ 371 (c)(1),
(2) Date: Oct. 9, 2023

(87) PCT Pub. No.: WO2022/218790

PCT Pub. Date: Oct. 20, 2022

(65) Prior Publication Data

US 2024/0188622 A1 Jun. 13, 2024

(30) Foreign Application Priority Data

Apr. 13, 2021 (EP) ..... 21168085

(51) Int. Cl.
*A24C 5/34* (2006.01)
*A24C 5/32* (2006.01)

(52) U.S. Cl.
CPC ..... *A24C 5/3412* (2013.01); *A24C 5/322* (2013.01)

(58) Field of Classification Search
CPC .. A24C 5/3412; A24C 5/322; G01N 21/8851; G01N 21/952; A24F 40/20; A24F 40/80
See application file for complete search history.

(56) References Cited

U.S. PATENT DOCUMENTS 6,169,600 B1 * 1/2001 Ludlow ..... G01N 21/952 131/905
7,766,013 B2 * 8/2010 Wensley ..... A61M 11/02 128/200.14

(Continued)

FOREIGN PATENT DOCUMENTS

CN 112113908 12/2020
CN 112557415 3/2021

(Continued)

OTHER PUBLICATIONS

PCT International Search Report and Written Opinion for PCT/EP2022/059185 filed Aug. 4, 2022 (14 pages).

(Continued)

*Primary Examiner* — Abdullahi Nur
(74) *Attorney, Agent, or Firm* — Mueting Raasch Group

(57) ABSTRACT

The invention relates to a method for checking an aerosol-generating article for manufacturing defects, comprising: —recording several 2-dimensional surface profiles of the aerosol-generating article while rotating the aerosol-generating article, —combining several surface profiles recorded at different rotation angles to obtain a 3-dimensional surface profile, calculating a maximum height difference of the 3-dimensional surface profile, and —rejecting the aerosol-generating article if the maximum height difference of its 3-dimensional surface profile is above a threshold value.

13 Claims, 8 Drawing Sheets

(56) References Cited

U.S. PATENT DOCUMENTS

| | | | | |
|---|---|---|---|---|
| 2006/0109485 | A1 | 5/2006 | Laemmel | |
| 2020/0260780 | A1 * | 8/2020 | Bessant | G06F 1/1652 |

FOREIGN PATENT DOCUMENTS

| | | | | |
|---|---|---|---|---|
| DE | 102012210031 | | 12/2013 | |
| DE | 102014209721 | | 11/2015 | |
| DE | 102018129256 | | 1/2020 | |
| EP | 1287484 | B1 * | 9/2004 | A24C 5/3412 |
| EP | 2568279 | | 3/2013 | |

OTHER PUBLICATIONS

International Preliminary Report on Patentability for PCT/EP2022/059185 dated Jul. 12, 2023 (15 pages).
Office Action issued in China for Application No. 202280021708.8 dated Apr. 25, 2026 (16 pages). English translation included.

* cited by examiner

METHOD FOR CHECKING AN AEROSOL-GENERATING ARTICLE FOR MANUFACTURING DEFECTS

This application is a U.S. National Stage Application of International Application No. PCT/EP2022/059185 filed Apr. 7, 2022, which was published in English on Oct. 20, 2022, as International Publication No. WO 2022/218790 A1. International Application No. PCT/EP2022/059185 claims priority to European application 21168085.5 filed Apr. 13, 2021.

The present invention relates to a method for checking an aerosol-generating article for manufacturing defects. The present invention further relates to an inspection device configured for detection of manufacturing defects in aerosol-generating articles. The present invention further relates to a system of an inspection device and an aerosol-generating article configured for detection of manufacturing defects in the aerosol-generating article.

Aerosol-generating articles comprise a substrate section comprising aerosol-forming substrate and additionally often a filter section which are both covered with wrapping paper. During the production of the aerosol-generating articles defects can occur in the aerosol-generating articles, such as delamination of the wrapping paper, a break between the connection of the filter section and the substrate section, wrinkles or stains in the wrapping paper. Detecting all the different defects, which can occur during the manufacturing of the aerosol-generating articles can be very difficult and time-consuming.

It would be desirable to provide a method for checking an aerosol-generating article for manufacturing defects, which is able to detect multiple different defects in an easy way. Furthermore, it would be desirable to provide a method for checking an aerosol-generating article for manufacturing defects, which is reliable. Additionally, it would be desirable to provide a method for checking an aerosol-generating article for manufacturing defects, which can be implemented as an in-line process control during the manufacturing of the aerosol-generating articles. Furthermore, it might be desirable to provide a method for checking the aerosol-generating articles for manufacturing defects which is accurate. It furthermore would be desirable to provide an inspection device, which is able to detect multiple different defects simultaneously.

According to an embodiment of the present invention a method for checking an aerosol-generating article for manufacturing defects may be provided. The method may comprise recording several 2-dimensional surface profiles of the aerosol-generating article while rotating the aerosol-generating article. The method may furthermore comprise combining several surface profiles recorded at different rotation angles to obtain a 3-dimensional surface profile. Furthermore, the method may comprise the step of calculating a maximum height difference of the 3-dimensional surface profile. Additionally, an aerosol-generating article may be rejected if the maximum height difference of its 3-dimensional surface profile is above a threshold value.

According to another embodiment of the present invention a method for checking an aerosol-generating article for manufacturing defects is provided. The method comprises recording several 2-dimensional surface profiles of the aerosol-generating article while rotating the aerosol-generating article. Several surface profiles recorded at different rotation angles are combined to obtain a 3-dimensional surface profile. A maximum height difference of the 3-dimensional surface profile is calculated and an aerosol-generating article is rejected if the maximum height difference of its 3-dimensional surface profile is above a threshold value.

Such a method for checking an aerosol-generating article for manufacturing defects may allow the detection of several manufacturing defects, which are normally not easily detected by visual detection methods. Additionally, such a method also may allow the detection of manufacturing defects located at different positions around the circumference of the aerosol-generating article.

The 2-dimensional surface profile may be a 2-dimensional height profile of the surface of the aerosol-generating article. The 2-dimensional height profile of the surface may be along the x-axis and the y-axis in the Cartesian coordinate system (x-y profile). The 2-dimensional height profile may depict depressions and bulges on the surface of the aerosol-generating article. The 2-dimensional height profile may depict differences in height of the surface of the aerosol-generating article. The 2-dimensional height profile may depict the lowest point and the highest point in the height profile of the surface of the aerosol-generating article.

Combining several 2-dimensional height profiles of the surface recorded at different rotation angles of the aerosol-generating article creates a 3-dimensional surface profile which may be along the x-axis, the y-axis and the z-axis in the Cartesian coordinate system (x-y-z profile).

These 3-dimensional surface profiles may ease the detection of manufacturing defects, which result in a change of the surface profile of the aerosol-generating article, such as wrinkles, holes, or protruding sections of the aerosol-generating article.

The method may comprise projecting the 3-dimensional surface profile on a 2-dimensional plane. The 2-dimensional projection of the 3-dimensional surface profile may comprise a plurality of the 2-dimensional surface profiles arranged one above the other. The 2-dimensional plane may depict a sequence of subsequently recorded 3-dimensional surface profiles at different rotation angles. The sequence of subsequently recorded 3-dimensional surface profiles may be recorded at equidistant rotation angles. For example, while recording the 2-dimensional surface profiles, the aerosol-generating article may be rotated in equidistant increments of between 1 degree to 9 degrees, preferably 2 degrees to 8 degrees, more preferably 3 degrees to 7 degrees.

The aerosol-generating article may be rotated 360 degrees while recording the several 2-dimensional surface profiles. This may allow obtaining a 360 degrees 3-dimensional surface profile of the complete surface of the aerosol-generating article. Between 30 and 550, preferably at least 200 2-dimensional surface profiles may be acquired, analysed and potentially recorded for one single aerosol-generating article. All these 2-dimensional surface profiles recorded at equidistant rotation angles may be combined to one single 3-dimensional surface profile, which may also be referred to as a 3-dimensional point cloud.

The analysis of the 3-dimensional surface profile, the point cloud may ease the detection of manufacturing errors in the aerosol-generating article.

The aerosol-generating article may be shaped in tubular form comprising a central longitudinal axis. During the recording of the several 2-dimensional surface profiles the aerosol-generating article may be rotated along its central longitudinal axis. This may allow recording the several 2-dimensional surface profiles of the aerosol-generating article along the longitudinal axis of the article at equidistant rotation angles. This may ease the inspection of at least a large section of the aerosol-generating article along its longitudinal axis. The 2-dimensional surface profile may be a 2-dimensional height profile of the surface of the aerosol-generating article along its longitudinal axis.

The aerosol-generating article may comprise a filter portion and a substrate portion. The substrate portion may comprise aerosol-forming substrate. The substrate portion may be tubular. A wrapper may be wrapped around the substrate portion of the aerosol-generating article. The wrapper may comprise paper, cardboard, plastic or a mixture thereof. The filter portion may comprise a plug of cellulose acetate tow. The filter portion may comprise for example a hollow acetate tube (HAT), a fine hollow acetate tube (FHAT) or a plug of tow wrapped around a central cardboard tube, all of which structures being known from manufacture of filter elements.

The aerosol-generating article may further comprise a tipping paper arranged at least partly wrapped around the filter portion and the substrate portion to overlap the filter portion and the substrate portion. The tipping paper may be overwrapping the filter portion and at least a part of the substrate portion adjacent to the filter portion. The tipping paper may be used to attach the components of the aerosol-generating article, in particular the filter portion and the substrate portion to each other.

According to a further embodiment of the method of the invention, several 2-dimensional surface profiles of at least the filter portion and parts of the substrate portion overwrapped by the tipping paper are recorded. This may allow the detection of manufacturing defects which can occur when the filter portion is connected to the substrate portion via the wrapping paper.

Aerosol-generating articles with a filter portion may be produced by inserting a double-length filter portion between two single length substrate portions. The double-length filter portion may then be attached to both substrate portions by overwrapping with tipping paper. An adhesive may be applied to an end portion of the tipping paper in order to enable a closing of the tipping paper around both substrate portions. This may provide a stable connection between both substrate portions and the double-length filter portion. Subsequently, the double-length filter portion is cut in the middle, releasing two single aerosol-forming articles each comprising a substrate portion and the filter portion. When connecting the double-length filter portion to both substrate portions manufacturing defects may occur. The method for checking for manufacturing defects may be particularly suitable for detecting any manufacturing defects which may occur during attachment of the filter portion to the substrate portion.

The threshold value may be the maximum deviation of the surface profile of a particular aerosol-generating article from a surface profile of an aerosol-generating article without manufacturing defects, which is still acceptable during manufacturing. The maximum height difference in a combined 3-dimensional surface profile of this aerosol-generating article may be determined by selecting the 2-dimensional surface profile of this combined 3-dimensional surface profile with the maximum height difference. Thus, the maximum height difference can be calculated as the maximum value of all the calculated maximum height differences for each profile. Every aerosol-forming article subjected to the method for checking for manufacturing defects may be accepted as being defect-free, if its maximum height difference of the 3-dimensional surface profile is below or at the threshold value. An aerosol-generating article may be rejected as including defects if its maximum height difference of the 3-dimensional surface profile is above the threshold value.

The threshold value may be between 0.4 to 0.6 millimeters, preferably between 0.48 to 0.52 millimeters.

The manufacturing defects, which may be detected by recording the 3-dimensional surface profile are selected from a group consisting of: tears, slits, holes, wrinkles, breaking, faulty adhesion of filter portion for substrate portion, and exposed connection between filter portion and substrate portion.

These manufacturing defects result in a change in the 3-dimensional surface profile of the aerosol-generating article, which can easily be detected with the method according to the invention.

The method for checking an aerosol-generating article for manufacturing defects may be accurate and rapid. The method may be part of a manufacturing process of the aerosol-generating articles and to be implemented as an in-line process control during the manufacturing process.

The method for checking for manufacturing defects may furthermore comprise the step of recording a 2-dimensional visual image or intensity line of the surface of the aerosol-generating article while rotating the aerosol-generating article. Several 2-dimensional surface visual images or several intensity lines recorded at different rotation angles may be combined to obtain a combined 2-dimensional visual surface image. The combined visual surface profile may be compared with a combined defect-free visual image of a defect-free aerosol-generating article via image-correlation. An aerosol-generating article may be rejected if its combined visual surface profile does not fit the defect-free visual image.

Several 2-dimensional surface visual images may be combined to obtain a combined 2-dimensional visual surface image. Alternatively, several intensity lines, in particular grayscale intensity lines may be combined to one combined 2-dimensional visual surface grayscale image. The recording of intensity lines, in particular grayscale intensity lines may be done with 2-dimensional linear camera.

Recording several 2-dimensional visual images or several intensity lines of the surface of the aerosol-generating article may allow the detection of manufacturing defects which are not easily detected employing the recording of the several 2-dimensional surface profiles.

At least one first visual marker may be present on the surface of the aerosol-generating article. The position of the first visual marker on the surface of the aerosol-generating article may be determined using the combined 2-dimensional visual surface image. The at least one first visual marker may comprise at least one line. The at least one first visual marker may be one line running around the circumference of the aerosol-generating article. The at least one first visual marker being one line may be located on the tipping paper. This at least one first visual marker may indicate the position of the tipping paper relative to the substrate portion and the filter portion.

Furthermore, a set of parallel lines may be present as a set of second visual markers. This set of parallel lines may be located on the tipping paper. At least two sets of parallel lines may be present. These at least two sets of parallel lines may be located at different positions of the tipping paper. When the tipping paper is wrapped around the aerosol-generating article, these at least two sets of parallel lines may be located at different positions of the circumference of the article. These at least two sets of parallel lines may allow to detect the position of the tipping paper around the circumference of the aerosol-generating article relative to the substrate portion.

All these visual markers may be detected employing the above-described method of recording either several 2-dimensional visual images or several intensity lines and combining these 2-dimensional surface visual images or several intensity lines to a combined 2-dimensional visual surface images of the aerosol-generating article. Visual markers also may include a marker indicating the brand of the aerosol-generating article, for example a trademark. The visual markers also may be located on the wrapping paper overwrapping the substrate portion of the aerosol-generating article.

These visual markers may be suitable to detect any dislocations of the tipping paper relative to the aerosol-generating article when attaching the filter portion to the substrate portion. These visual markers also may be suitable to detect any displacement of the substrate portion relative to the filter portion or its wrapping paper. These visual markers also may suitable to detect wrinkles or faulty overwrapping of the wrapping paper of the substrate portion.

The manufacturing defects which may be detected by recording the visual images or the intensity lines of the surface of the aerosol-generating article may be selected from a group consisting of: stains, displacement of the tipping paper relative to the substrate portion, mixing of different brands of aerosol-generating articles, and folding of the tipping paper.

Recording the 2-dimensional visual image of the surface of the aerosol-generating article may allow the detection of manufacturing defects, which otherwise cannot be detected or are hard to detect by recording the several 2-dimensional surface profiles.

Any changes of the position or appearance of the visual marker or any of the above-described manufacturing defects may be detected via image correlation. The actual recorded combined 2-dimensional visual surface image may be compared via image correlation to the reference 2-dimensional visual surface image of a defect-free aerosol-generating article. Similarly, the position of the one continuous line running around the circumference of the aerosol-generating article or the positions and the appearances of the sets of parallel lines may be compared to a reference image via image correlation.

During the recording of the either several 2-dimensional surface visual images or the several intensity lines, the aerosol-generating article may be rotated 360 degrees. This may allow combining the several 2-dimensional surface visual images or the several intensity lines to a combined 360 degrees 2-dimensional visual surface image covering the complete surface of the aerosol-generating article.

A plurality of 2-dimensional surface visual images may be recorded at equidistant rotation angles of the aerosol-generating device. Between 30 and 550, preferably at least 200 2-dimensional visual surface images may be recorded and may be combined to one combined 2-dimensional visual surface image.

The several 2-dimensional surface profiles and several 2-dimensional visual surface images or the several intensity lines may be recorded simultaneously. This may allow to simultaneously obtain a 3-dimensional surface profile and a combined 2-dimensional visual surface image in order to detect a large variety of different manufacturing defects.

A surface profile sensor may be employed, which is configured for recording either the several 2-dimensional surface profiles or the several intensity lines of the aerosol-generating article. Analogously a visual imaging sensor may be employed, which is configured for recording several 2-dimensional visual images of the surface of the aerosol-generating article. One or both of the surface profile sensor and the visual imaging sensor may be a laser sensor.

According to another embodiment of the method of the invention, a separate 2-dimensional laser sensor and a separate 3-dimensional laser sensor may be present. The 2-dimensional laser sensor may be configured to record either the several 2-dimensional surface visual images or the several intensity lines and the 3-dimensional laser sensor may be configured to record the several 2-dimensional surface visual images to be combined to 3-dimensional surface profile.

The 2-dimensional laser sensor and the separate 3-dimensional laser sensor may be located at different positions, for example one sensor below the aerosol-generating article and one sensor above the article.

Preferably both the surface profile sensor and the visual imaging sensor are integrated in one single sensor head. The single sensor head preferably is a line laser sensor head.

The laser sensor head may be employed for recording one or both of:

the several 2-dimensional surface profiles, or either the several 2-dimensional surface visual images or the several intensity lines.

This laser sensor head may allow a rapid and accurate recording of both the surface profiles and the surface visual images. A line laser sensor head may be employed. A line laser sensor head may comprise a laser source for generating a laser beam and optics for projecting the laser beam as a laser line. A line laser therefore may allow the recording of one or both of 2-dimensional surface profiles or either the 2-dimensional visual surface images or the several intensity lines over at least a part, preferably over the entire length of the aerosol-generating article during one single scanning operation.

One single laser sensor head, preferably a single line laser sensor head may be employed to record one or both of the several 2-dimensional surface profiles of the aerosol-generating article and the several 2-dimensional surface visual images. The several 2-dimensional surface profiles and either the several 2-dimensional surface visual images or the several intensity lines may preferably be recorded simultaneously.

This may allow a rapid and accurate detection of both the 3-dimensional surface profile and the combined 2-dimensional visual surface image at the same time. The combination of both detection methods may allow detecting various different manufacturing defects of the aerosol-generating article, which otherwise may the hard to simultaneously monitor during the manufacturing process of the aerosol-generating articles.

The laser sensor head may be a laser profiler. A laser profiler comprises a combination of laser source and an area scan high-speed sensor. This allows the emission of a laser beam and the detection of the laser beam reflected from the surface of the aerosol-generating article in one device. As mentioned above, the laser profiler may comprise a line laser. This may allow the recording of surface profiles and surface visual images of large parts of the surface of the aerosol-generating article in one scan step. The laser profiler may be a 2-D/3-D laser profiler. Such 2-D/3-D laser profiler may comprise a 2-dimensional laser scanner or a linear sensor camera and 3-dimensional laser scanner. The 2-dimensional laser scanner or the linear sensor camera may be configured to record either the several 2-dimensional surface visual images or the several intensity lines and combine them to the combined 2-dimensional visual surface image of the aerosol-generating article. The 2-dimensional laser scanner or the linear sensor camera may include a grayscale or RGB linear or area scan sensor camera. The 3-dimensional laser scanner may be configured to record several 2-dimensional surface profiles of the aerosol-generating article and combine them to a 3-dimensional surface profile. The 3-dimensional laser scanner may record various different 2-dimensional surface profiles corresponding to different rotational angles of the aerosol-generating article. This may allow the collection of different recorded data in the 3-dimensional space, so-called "3D point cloud acquisition".

The aerosol-generating article may be rotated at the speed of between 16000 and 1200, preferably a speed between 15000 and 2400 more preferably between 15000 and 10000 rounds per minute (rpm).

Such a speed range may be sufficient in order to integrate the method for checking for manufacturing defects into the manufacturing process of the aerosol-generating articles as an in-line process control.

The aerosol-generating article may be rotated between either:

two rotating drums, one rotating drum and one stationary part, or one moving belt and one stationary part.

Any of these configurations may be suitable in order to rotate the aerosol-generating article while recording one or both of the several 2-dimensional surface profiles or the several 2-dimensional surface visual images.

Employing two rotating drums is the preferred way of rotating the aerosol-generating article during the recording of one or both of the several 2-dimensional surface profiles or the several 2-dimensional surface visual images. The two drums may rotate in opposite directions. Employing the two rotating drums may allow the laser sensor to be in a stationary position and nevertheless record images of a large part or preferably of the complete surface of the aerosol-generating article due to the rotation. One of the rotating drums may be a vacuum drum. This vacuum drum may comprise vacuum holes for generating a vacuum which are able to keep the aerosol-generating article in place while rotating the vacuum drum. The vacuum drum may comprise different sets of vacuum holes, which are arranged around the circumference of the drum. The first rotating vacuum drum may have a diameter larger than other second rotating drum. The vacuum drum may hold the aerosol-generating article to be evaluated in place and rotate it during the production process until it reaches the other drum. Once the other drum is reached, the aerosol-generating article may fall off the vacuum holes and may be rotated between the vacuum drum and the other drum. During rotation, the laser sensor may record one or both of either the several surface profiles or the several intensity lines or the several 2-dimensional surface visual images. The aerosol-generating article afterwards may continue to be transported by the vacuum drum further down the production line, when the next set of vacuum holes of the drum again picks up the aerosol-generating article for further transportation.

Alternatively, the aerosol-generating article may be rotated between one rotating drum and one stationary part. The stationary part may be part of the production line for the aerosol-generating articles. The stationary part may least be partially transparent or partially open in order to allow inspection of the aerosol-generating article. The rotating drum may be a vacuum drum which keeps the aerosol-generating article in place due to the vacuum holes and transports it to the stationary part. Once the aerosol-generating article reaches the stationary part, it becomes disconnected from the vacuum holes of the drum and starts rotating between the rotating drum and the stationary part. The laser sensor may be stationary. The laser sensor may be able to monitor a part or the complete surface of the aerosol-generating article due to the rotation of the article.

The aerosol-generating article may be rotated between one moving belt and one stationary part. The belt may be linear or circular. The stationary part may be a part of the production line for producing the aerosol-generating articles. Due to the relative movement of the moving belt in relation to the stationary part, the aerosol-generating article is rotated. Therefore, in this embodiment the laser sensor also might be stationary.

According to another embodiment of the method of the invention, the aerosol-generating article is transported between a moving belt and a stationary part of the production line. The stationary part may at least be partly transparent or open in order to allow inspection of the aerosol-generating article secured between the belt and the stationary part. The stationary part, for example may be straps securing the aerosol-generating article to the moving belt. In this case, the laser sensor may perform one or both of rotational or translational movement in order to be able to record the images.

A mirror configured to be rotatable may be present. The mirror may rotate in order to project the image of the aerosol-generating article to a laser sensor in the case that the laser sensor is stationary and the aerosol-generating article is moving relative to the laser sensor. The rotating mirror may allow the laser sensor to record a large part or all of the surface of the aerosol-generating article. The rotating mirror may be particular advantageous when one rotating drum and one stationary part or when one moving belt and one stationary part are employed.

The invention also provides an inspection device configured for detection of manufacturing defects in aerosol-generating articles. The inspection device may comprise a surface profile sensor configured for recording several surface profiles of the aerosol-generating article. The inspection device also may comprise rotating means configured for rotating the aerosol-generating article during the recording of the surface profiles. Surface profile controller may be present in the inspection device, the surface profile controller configured for processing the several 2-dimensional surface profiles recorded at different rotation angles to obtain a 3-dimensional surface profile. The surface profile controller may be configured for calculating at maximum height difference of the 3-dimensional surface profile.

According to a further embodiment of the invention an inspection device configured for detection of manufacturing defects in aerosol-generating articles is provided. The inspection device comprises a surface profile sensor configured for recording several surface profiles of the aerosol-generating article. Furthermore, the inspection device also comprises rotating means configured for rotating the aerosol-generating article during the recording of the surface profiles. The surface profile controller is configured for processing the several surface profiles recorded at different rotation angles to obtain a 3-dimensional surface profile and is also configured for calculating a maximum height difference of 3-dimensional surface profile.

Such an inspection device can easily record the surface profiles of the aerosol-generating article at different rotation angles of the aerosol-generating article due to the rotating means. The surface profile controller processes these surface profiles in order to obtain a 3-dimensional surface profile.

The surface profile controller furthermore may be able to control the rotating means. This may allow a reliable recording of several surface profiles at different rotation angles.

The surface profile controller furthermore may be configured to control the surface profile sensor.

The inspection device furthermore may comprise a visual imaging sensor configured for recording a 2-dimensional visual image of the surface of the aerosol-generating article while rotating the aerosol-generating article. The inspection device furthermore may comprise a visual imaging controller configured for processing the several 2-dimensional surface visual images at different rotation angles. The visual imaging controller may be configured to process these several 2-dimensional surface visual images in order to obtain a combined 2-dimensional visual surface image. The visual imaging controller also may be configured to compare the combined visual surface profile with a combined defect-free visual image of a defect-free aerosol-generating article via image-correlation.

Such an inspection device can monitor the 3-dimensional surface profile and additionally the visual image of the surface of the aerosol-generating article. Preferably, the inspection device is configured to record either the several 2-dimensional visual images or the several intensity lines of the surface of the aerosol-generating article and the several 2-dimensional surface profiles simultaneously.

Such an inspection device may be configured to check the various manufacturing defects which can either be detected employing the surface profiling or by visual imaging of the surface of the aerosol-generating article.

The visual image controller may be able to control the rotating means. The visual image controller furthermore may be configured to control the visual imaging sensor. Preferably, the surface profile controller and the visual image controller are integrated into one control unit.

This control unit therefore may be configured to process one or both of the several 2-dimensional surface visual images and the several 2-dimensional surface profiles. The control unit may be configured to combine one or both of the several 2-dimensional surface visual images and the several 2-dimensional surface profiles in order to obtain one or both of 3-dimensional surface profile and the combined 2-dimensional visual surface image. These data then may be processed by the control unit, for example by using software in order to obtain the 3-dimensional surface profile. The control unit also may be configured to control one or both the visual image controller and the surface profile sensor.

The surface profile sensor and the visual image controller may be both integrated into one sensor head, as already mentioned above. Preferably this single sensor head is a laser sensor head, more preferably a line laser sensor head. The laser sensor head may be a 2-D/3-D laser profiler, as mentioned above. The control unit may control the 2-D/3-D laser profiler.

One example for 2-D/3-D laser profilers are the LJ-V7000 Series High-speed 2-D/3-D laser profilers marketed by Keyence. One particular example of a 2-D/3-D laser profiler is the sensor head LJ-V7200B manufactured by Keyence. Another example for a 2-D/3-D laser profiler is the 3D machine vision Ranger 3, marketed by Sick.

One example for a control unit configured to control one or both the visual image controller and the surface profile sensor, in particular 2-D/3-the laser profiler are the XG-X series controllers marketed by Keyence. One particular example of a controller is the CV-X/XG-X controller which can be connected to any of the LJ-V7000 Series High-speed 2-D/3-D laser profilers.

The rotating means may comprise either:

two rotating drums, one rotating drum and one stationary part, or one moving belt and one stationary part.

These different embodiments of rotating means may be controlled by one or both of the visual imaging controller and the surface profile controller. Preferably, the control unit integrating both the surface profile controller and the visual imaging controller also is configured to control these rotating means.

Such an inspection device would be configured to provide detection of a large variety of different manufacturing defects which can be detected with both surface profiling and visual imaging. Such an inspection device furthermore would be fully integrated, configured to provide an automated system of detection of manufacturing defects while rotating the aerosol-generating article.

Another object of the present invention is to provide an inspection system. The inspection system comprises an inspection device as described herein and an aerosol-generating article. The aerosol-generating article is to be inspected for various manufacturing defects as mentioned above.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of the aerosol-generating article or smoking article.

The aerosol-forming substrate is a substrate capable of releasing volatile compounds that can form an aerosol. The volatile compounds may be released by heating the aerosol-forming substrate. The aerosol-forming substrate may comprise nicotine. The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material, including homogenized tobacco, for example made by, for example, a paper making process or a casting process.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are for example: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The aerosol-former may be propylene glycol. The aerosol former may comprise both glycerine and propylene glycol.

The aerosol-generating article may generate an aerosol by lighting the article and heating the aerosol-forming substrate above a combustion temperature. Alternatively, the aerosol-generating article may generate an aerosol by heating the aerosol-forming substrate to a temperature below combustion temperature. Such an aerosol-generating article may also be referred to as a "heat-not-burn product".

Below, there is provided a non-exhaustive list of non-limiting examples. Any one or more of the features of these examples may be combined with any one or more features of another example, embodiment, or aspect described herein.

Example A: Method for checking an aerosol-generating article for manufacturing defects, comprising:

recording several 2-dimensional surface profiles of the aerosol-generating article while rotating the aerosol-generating article, combining several surface profiles recorded at different rotation angles to obtain a 3-dimensional surface profile, calculating a maximum height difference of the 3-dimensional surface profile, and rejecting the aerosol-generating article if the maximum height difference of its 3-dimensional surface profile is above a threshold value.

Example B: Method according to Example A, wherein the 3-dimensional surface profile is projected on a 2-dimensional plane, preferably wherein the 2-dimensional projection of the combined several surface profiles comprises a sequence of 2-dimensional surface profiles recorded at equidistant rotation angles.

Example C: Method according to any of the preceding examples, wherein the aerosol-generating article is shaped in tubular form comprising a central longitudinal axis, preferably wherein the aerosol-generating article is rotated along its longitudinal axis and wherein the several 2-dimensional surface profiles of the aerosol-generating article are recorded along the longitudinal axis at equidistant rotation angels, more preferably wherein a 2-dimensional surface profile is a 2-dimensional height profile of the surface of the aerosol-generating article along the longitudinal axis.

Example D: Method according to any of the preceding examples, wherein the aerosol-generating article comprises a filter portion and a substrate portion, the substrate portion comprising aerosol-forming substrate, further wherein the aerosol-generating article comprises a tipping paper overwrapping the filter portion and at least a part of the substrate portion adjacent to the filter portion.

Example E: Method according to the preceding Example D, wherein several 2-dimensional surface profiles of at least the filter portion and parts of the substrate portion overwrapped by the tipping paper are recorded.

Example F: Method according to any of the preceding examples, wherein the threshold value for the maximum height difference is a maximum distance between the lowest point and the highest point in the 3-dimensional surface profile, preferably wherein the threshold value is between 0.44 to 0.52 millimeters, preferably between 0.46 to 0.50 millimeters, more preferably between 0.47 to 0.49 millimeters.

Example G: Method according to any of the preceding examples, wherein the manufacturing defects are selected from a group consisting of tears, slits, holes, wrinkles, breaking, faulty adhesion of filter portion to substrate portion, and exposed connection between filter portion and substrate portion.

Example H: Method according to any of the preceding examples, wherein additionally a 2-dimensional visual image of the surface of the aerosol-generating article is recorded while rotating the aerosol-generating article several 2-dimensional surface visual images or intensity lines are recorded at different rotation angles are combined to obtain a combined 2-dimensional visual surface image, the combined visual surface profile is compared with a combined defect-free visual image of a defect-free aerosol-generating article via image-correlation, and the aerosol-generating article is rejected if its combined visual surface profile does not fit the defect-free visual image.

Example I: Method according to the preceding examples, wherein at least one visual marker is present on the surface of the aerosol-generating article and wherein the position of the visual marker on the surface of the aerosol-generating article is determined using the combined 2-dimensional visual surface image, preferably wherein the visual marker comprises at least one line.

Example J: Method according to the preceding Example I and Example D, wherein the at least one visual marker is present on the tipping paper and wherein the position of the visual marker on the surface of the aerosol-generating article is used in order to determine the position of the tipping paper relative to the substrate portion.

Example K: Method according to any of the Example H to Example J, wherein the manufacturing defects are selected from a group consisting of stains, displacement of the tipping paper relative to the substrate portion, mixing of different brands of aerosol-generating articles and folding of the tipping paper.

Example L: Method according to any of the preceding examples, wherein the aerosol-generating article is rotated 360 degrees and wherein one or both:

a 360 degree 3-dimensional surface profile, or a 360 degree combined 2-dimensional visual surface image are obtained.

Example M: Method according to any of the preceding examples, wherein a line laser sensor is employed for recording one or both of:

the several 2-dimensional surface profiles, or the several 2-dimensional surface visual images.

Example N: Method according to the preceding Example L, wherein one single line laser sensor is employed to record one or both of the several surface profiles of the aerosol-generating article and the several 2-dimensional surface visual images or intensity lines, preferably wherein the several surface profiles and the several 2-dimensional surface visual images are recorded simultaneously.

Example O: Method according to any of the preceding examples, wherein the aerosol-generating article is rotated between either:

two rotating drums, one rotating drum and one stationary part, one moving belt and one stationary part.

Example P: Method according to any of the preceding examples, wherein two different sensors are employed for recording the several 2-dimensional surface visual images and the several surface profiles.

Example Q: Inspection device configured for detection of manufacturing defects in aerosol-generating articles, comprising:

a surface profile sensor configured for recording several 2-dimensional surface profiles of the aerosol-generating article, rotating means configured for rotating the aerosol-generating article during the recording of the surface profiles, and a surface profile controller configured for processing the several 2-dimensional surface profiles recorded at different rotation angles to obtain a 3-dimensional surface profile, and configured for calculating a maximum height difference of the 3-dimensional surface profile.

Example R: Inspection device according to the preceding Example Q, further comprising:

a visual imaging sensor configured for recording several 2-dimensional visual images or intensity lines of the surface of the aerosol-generating article while rotating the aerosol-generating article, and a visual imaging controller configured for processing the several 2-dimensional surface visual images or intensity lines at different rotation angles to obtain a combined 2-dimensional visual surface image and configured for comparing the combined visual surface profile with a combined defect-free visual image of a defect-free aerosol-generating article via image-correlation.

Example S: Inspection device according to the preceding Example R, wherein the visual imaging sensor and the surface profile sensor are integrated in one single sensor head, preferably wherein the sensor head is a line laser sensor head.

Example T: Inspection device according to the preceding Examples Q to S, wherein the surface profile controller and the visual imaging controller are integrated into one single control unit.

Example U: Inspection device according to the preceding Examples Q to T, wherein the rotating means comprises either:

two rotating drums, one rotating drum and one stationary part, one moving belt and one stationary part.

Example V: Inspection system comprising an inspection device according to the preceding claims Examples Q to U, and an aerosol-generating article.

Features described in relation to one embodiment may equally be applied to other embodiments of the invention.

The invention will be further described, by way of example only, with reference to the accompanying drawings in which.

In the following the same elements are marked with the same reference numerals throughout all the figures.

Figure 1:
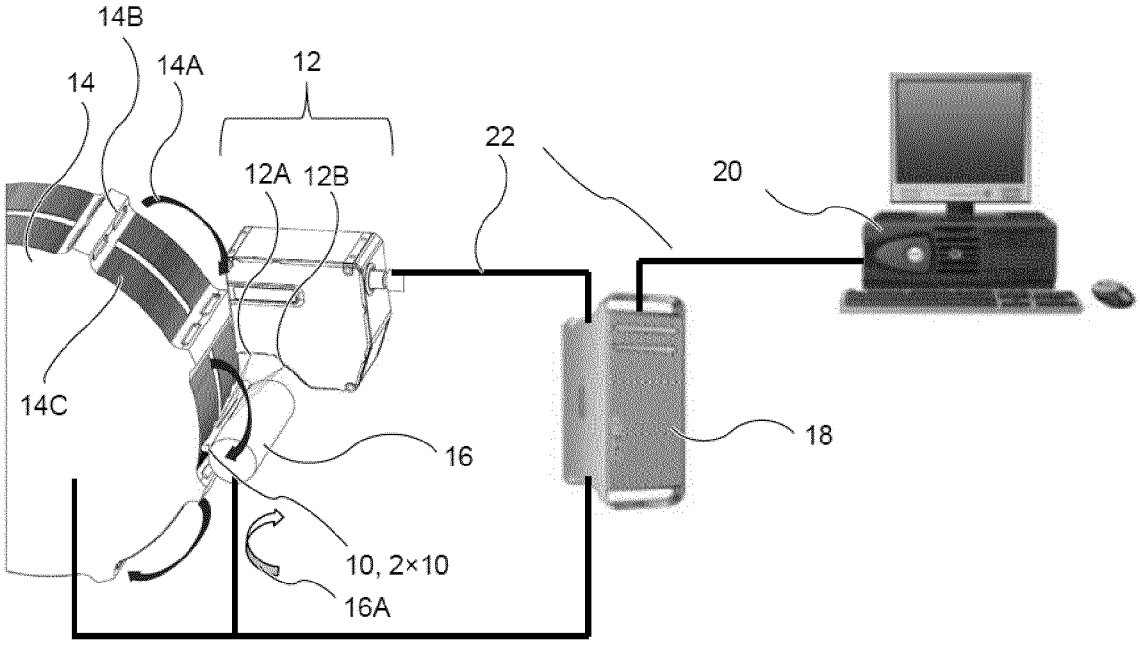
FIG. 1 shows a schematic, perspective view of an inspection device and an inspection system according to one embodiment of the invention.

FIG. 1 depicts an inspection device and an inspection system configured for detection of manufacturing defects in aerosol-generating articles according to one embodiment of the invention. The inspection device is preferably employed as so-called "in-line quality inspection" during the manufacturing process of the aerosol-generating articles. The inspection device comprises a laser sensor 12, in particular a 2-D/3-D laser profiler which includes a laser 12A and a sensor 12B integrated in one sensor head. The 2-D/3-D laser profiler scans the surface of an aerosol-generating article 10, or the surface of a so-called "double stick" 2×10, which contains two aerosol-generating articles, which are connected by a double filter portion connected on both sides to substrate portions. In the following, when we refer to the "aerosol-generating article" 10, this is similarly meant to include the "double stick" 2×10, if not mentioned otherwise. The 2-D/3-D laser profiler may be configured to record the several 2-dimensional surface profiles and the several 2-dimensional surface visual images of the aerosol-generating article or the double stick simultaneously. The aerosol-generating article is rotated between rotating means, a first rotating drum 14 and second rotating drum 16. The first rotating drum rotates in the direction indicated by the arrows 14A and the second rotating drum 16 rotates in an opposite direction indicated by the arrow 16A. This allows the 2-D/3-D laser profiler to scan large parts of the surface of the aerosol-generating article 10, preferably the complete surface of the aerosol-generating article in the case that the article is rotated by 360 degrees. During the scanning process the 2-D/3-D laser profiler is kept stationary. The first rotating drum 14 includes protrusions 14B which are able to transport the aerosol-generating article 10 further through the manufacturing process. Initially, the aerosol-generating article 10 is kept in place on the first rotating drum 14 via vacuum holes 14C. Once an aerosol-generating article held by the vacuum holes 14C reaches the second rotating drum 16, the article starts rotating and inspection of the article by the 2-D/3-D laser profiler begins. Inspection of the aerosol-generating article comes to an end when the next protrusion 14B of the first rotating drum 14 pushes the aerosol-generating article 10 away from the second rotating drum 16. Thus, an aerosol-generating article 10 is rotated between the first rotating drum and second rotating between adjacent protrusions 14B of the first rotating drum 14. The first and the second rotating drums 14 and 16 and the 2-D/3-D laser profiler are connected via communication connections 22 to a control unit 18. The control unit 18 is configured to process one or both of either the several two-dimensional surface visual images or the several intensity lines and several two-dimensional surface profiles. In particular, the control unit 18 may be configured to combine either the several two-dimensional surface visual images or the several intensity lines to obtain combined-dimensional visual surface image. Similarly, the control unit 18 may be configured to combine several two-dimensional surface profiles in order to obtain 3-dimensional surface profile. A workstation 20 is present, connected to the control unit 18 via a communication connection 22. The workstation 20 allows the user to handle the inspection device. Such an inspection device is configured to provide an in-line inspection of the manufactured aerosol-generating articles during the manufacturing process. This in-line inspection allows for the detection of various different manufacturing defects, which either can be detected preferably by visual imaging or surface profiling. This inspection device therefore allows the user to carry out the method for checking for manufacturing defects of the present invention in an automated way.

Figure 2:
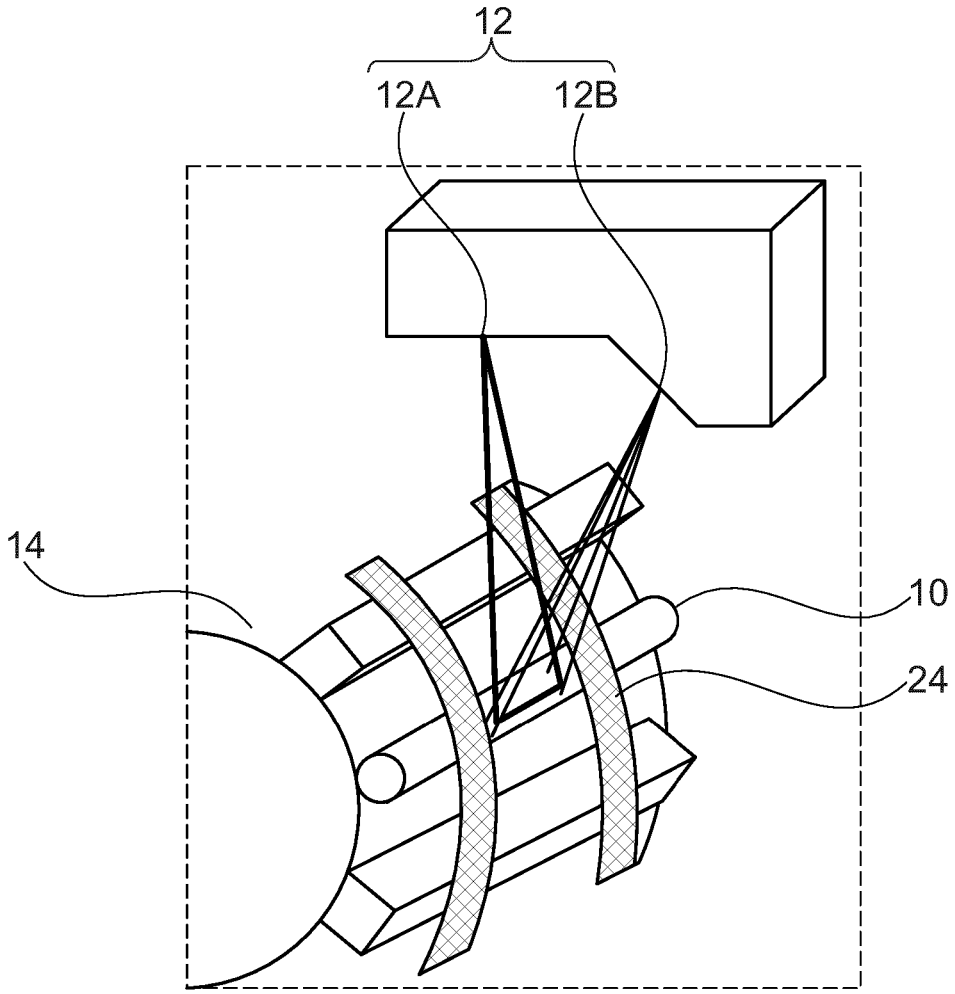
FIG. 2 shows a schematic drawing of a 2-D/3-D laser profiler inspecting an aerosol-generating article between a first rotating drum and straps.

FIG. 2 depicts another embodiment of rotating means for the inspection device, which may be integrated into the inspection device of FIG. 1 instead of the two rotating drums. In this embodiment the rotating means include a first rotating drum 14 and straps 24, which secure the aerosol-generating article 10 to the rotating drum. In this case, the 2-D/3-D laser profiler 12 including the laser 12A and the sensor 12B has to move together with the first drum, in order to inspect different parts of the surface of the aerosol-generating article.

Figure 3A:
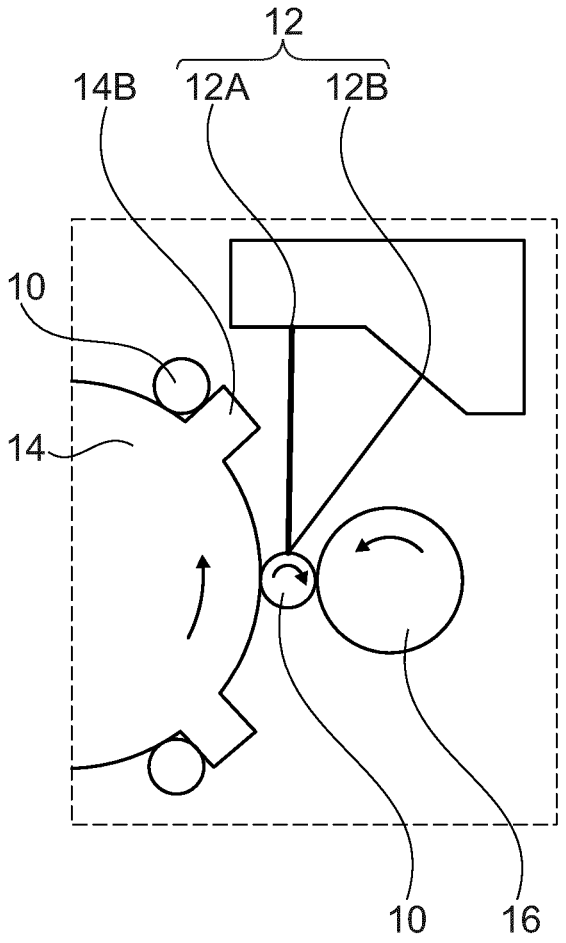
FIGS. 3A and 3B shows cross-sectional views of a 2-D/3-D laser profiler scanning an aerosol-generating article rotating between two rotating drums.
Figure 3B:
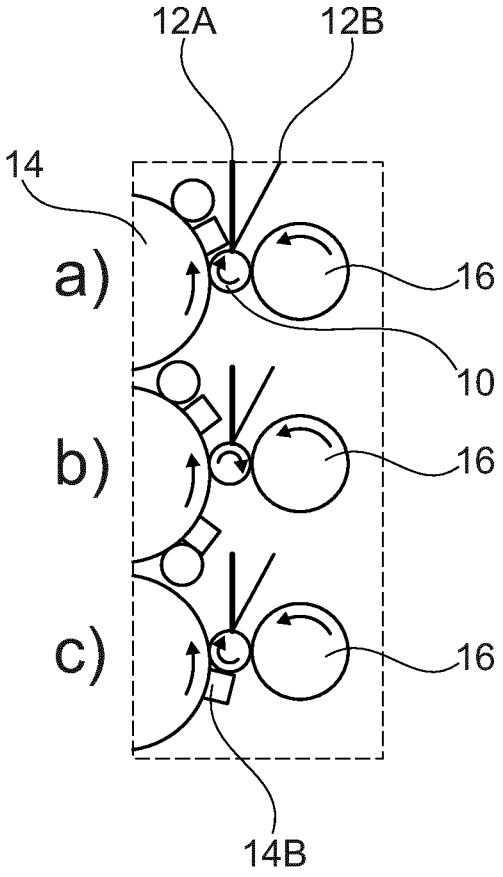

FIG. 3A depicts two rotating drums 14 and 16, rotating in opposite directions as rotating means in a cross-sectional view. FIG. 3B shows a cross-sectional view of the different, subsequent steps of transporting the aerosol-generating article 10 with the two rotating drums 14 and 16. In the first step denoted with "a)" the aerosol-generating article 10, which is held in place by the vacuum holes of the first rotating drum 14 gets caught between drums 14 and 16 and starts rotating (vacuum holes not shown in FIG. 3B). During the rotation the 2-D/3-D laser profiler scans the surface of the aerosol-generating article as shown in the second step denoted with "b)" (only beams 12A and 12B of the laser profiler are shown). In the final step denoted with "c)" the next protrusion 14B of the first rotating drum 14 picks up the aerosol-generating article 10, thereby terminating the inspection of the aerosol-generating article in order to transport it further through the manufacturing process.

Figure 4:
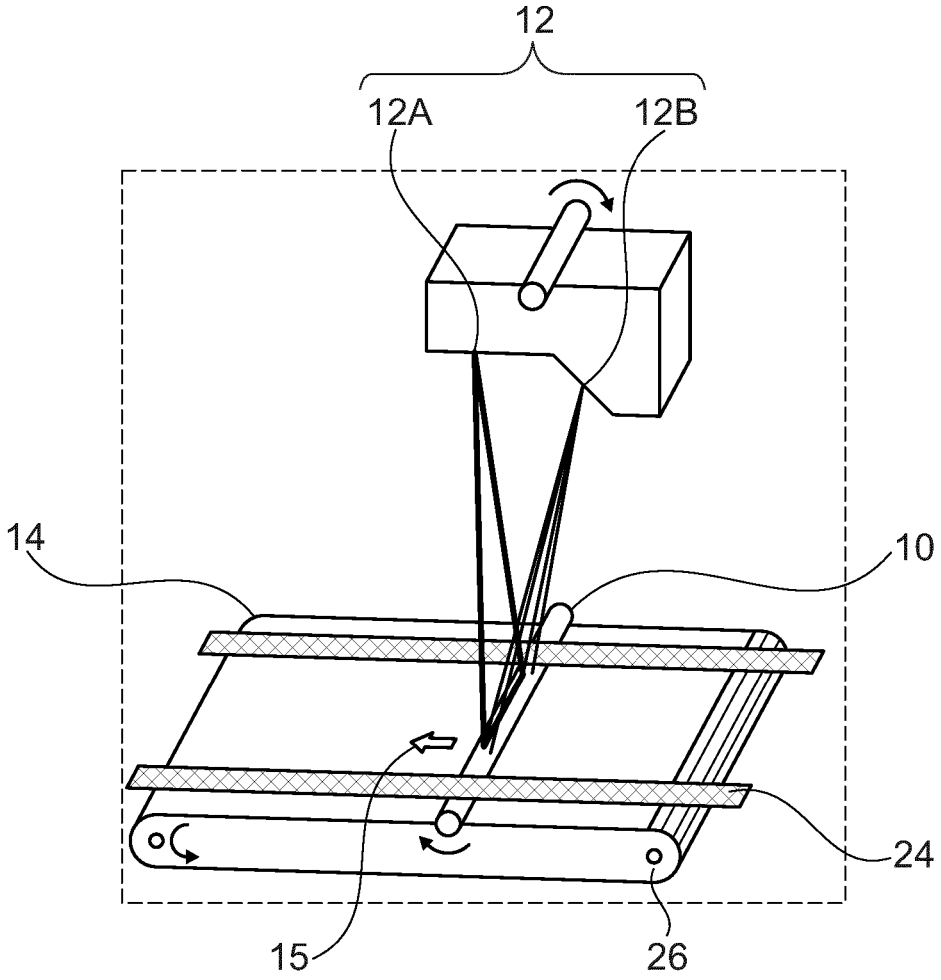
FIG. 4 depicts another schematic perspective drawing showing a moving 2-D/3-D profiler inspecting an aerosol-generating article rotating between a moving belt and straps.

FIG. 4 depicts a perspective schematic view of another embodiment of rotating means, which can be incorporated into the inspection device shown in FIG. 1. In this case, the aerosol-generating article 10 is secured between the moving belt 26 and straps 24. Since the straps 24 are stationary part of the device, the aerosol-generating article 10 starts rotating between the stationary straps 24 and the moving belt 26 and at the same time is moved in the direction indicated by the arrow 15 (roto-translation of the aerosol-generating article). In order to scan all or a large part of the surface of the aerosol-generating article, the 2-D/3-D profiler 12 has to follow the translation of the aerosol-generating article indicated by the arrow 15.

Figure 5A:
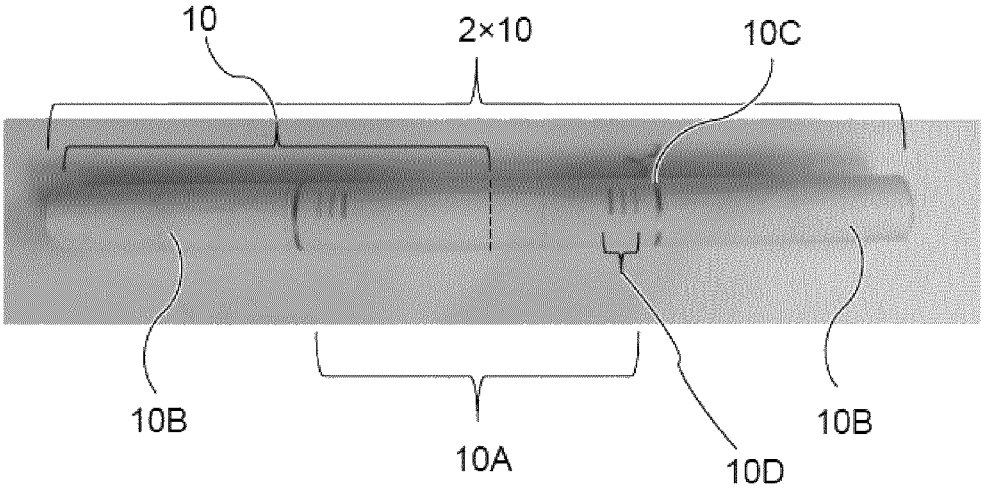
FIGS. 5A and 5B show a photograph of defect-free double stick containing two aerosol-generating articles connected via the filter portion and one single 2-dimensional surface profile of that double stick, respectively.

FIG. 5A shows a photograph of a double stick 2×10, which includes two substrate portions 10B, which are connected to one double filter portion 10A by tipping paper. The dashed line in FIG. 5A indicates the cut line for cutting the double stick in order to produce two single aerosol-generating articles 10. In this case, the double stick does not contain any manufacturing defects. One continuous first visual marker 10C is present on the double stick, which is a line running around the circumference of the double stick. Furthermore, a set of second visual markers 10D is present on the tipping paper of the double stick. The first and the set of second visual markers can be used in order to monitor the correct position of the tipping paper, when connecting the double filter portion 10A to both substrate portions 10B.

Figure 5B:
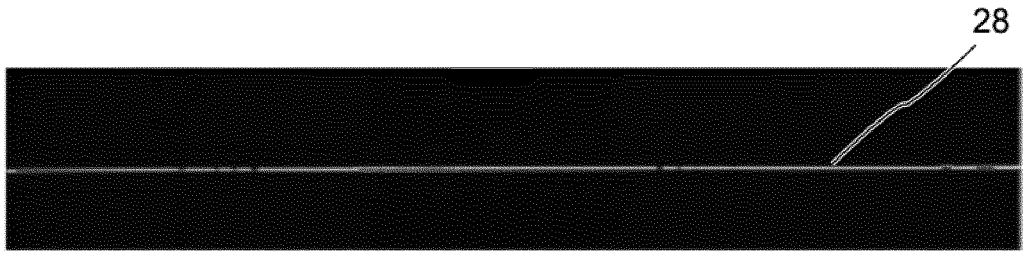

FIG. 5B shows one single two-dimensional surface profile of the double stick shown in FIG. 5A. Since no defects are present in this double stick, the two-dimensional surface profile is even and does not show any great protrusions above the threshold level.

Figure 6A:
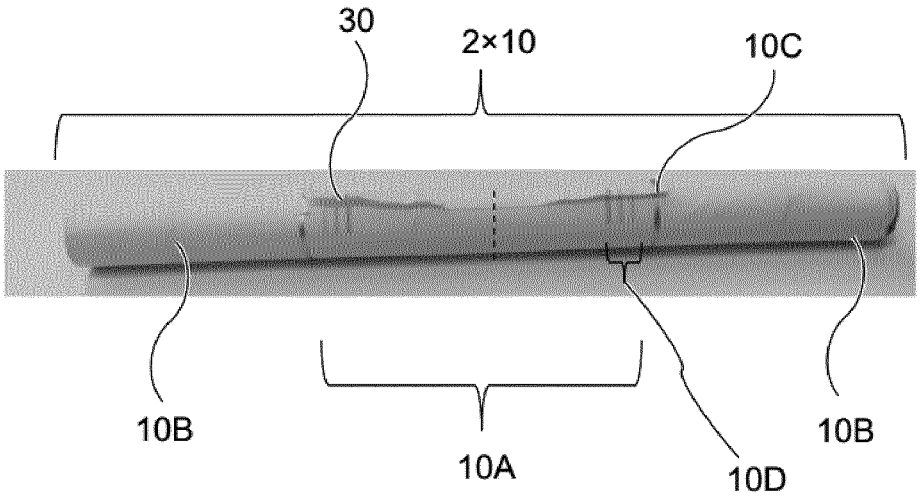
FIGS. 6A and 6B show a photograph of a double stick containing two aerosol-generating articles including a manufacturing defect and one single 2-dimensional surface profile of that double stick, respectively.

FIG. 6A shows a photograph of another double stick 2×10, which includes a manufacturing defect 30. In particular, the tipping paper has been delaminated from the double stick and protrudes from the double stick.

Figure 6B:
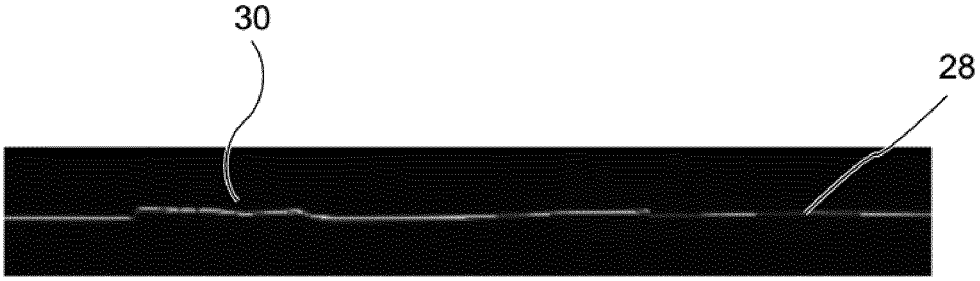

FIG. 6B shows a single 2-dimensional surface profile 28 of the double stick shown in FIG. 6A in the region, where the manufacturing defect 30 is present. The protrusions 30 of the manufacturing defect are clearly visible in the 2-dimensional surface profile 28. Therefore, recording 2-dimensional surface profiles and combining them to a 3-dimensional surface profile is particularly suitable in order to detect manufacturing defects which involve changes in the surface profile of the double stick.

Figure 7:
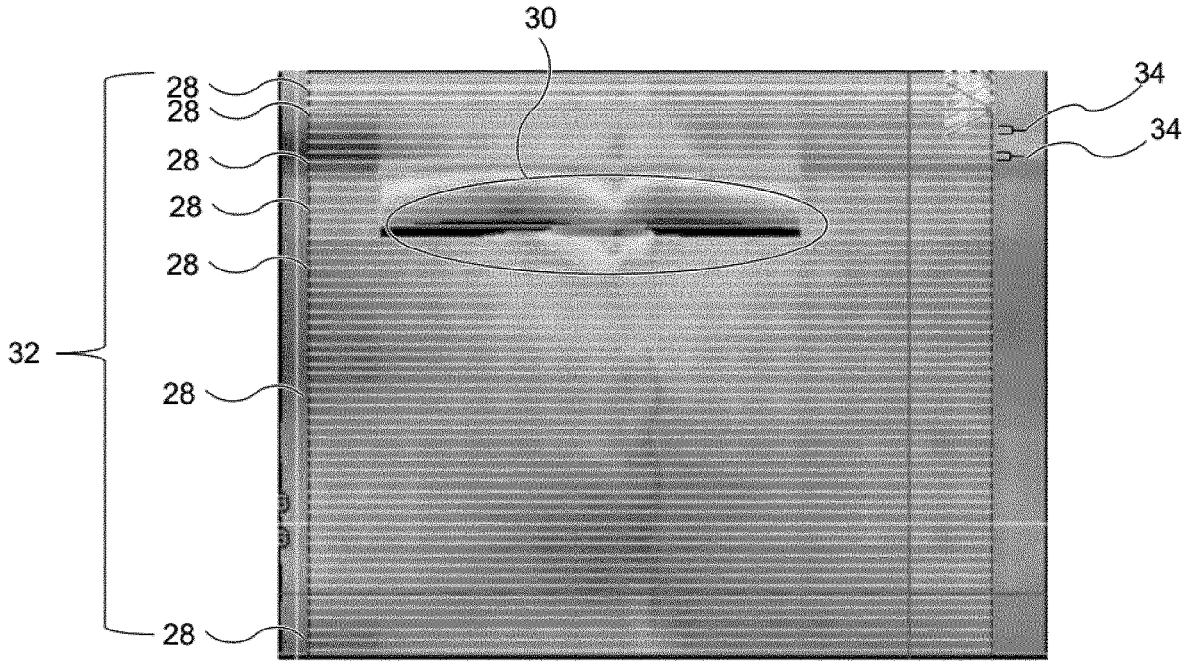
FIG. 7 shows a 3-dimensional surface profile of an aerosol generating article including a manufacturing defect projected on a 2-dimensional plane.

FIG. 7 shows a 2-dimensional projection 32 of a 3-dimensional surface profile. Several 2-dimensional surface profiles 28 are aligned one above the other. Adjacent surface profiles 28 are separated by the so-called "step size" 34, which are equidistant rotation angles. One single 2-dimensional surface profile 28 is indicated by a single bright line in FIG. 7. For the sake of clarity only a few of the bright lines are marked with the reference numeral 28. Manufacturing defect 30 is clearly visible in the 3-dimensional surface profile 32.

Figure 8A:
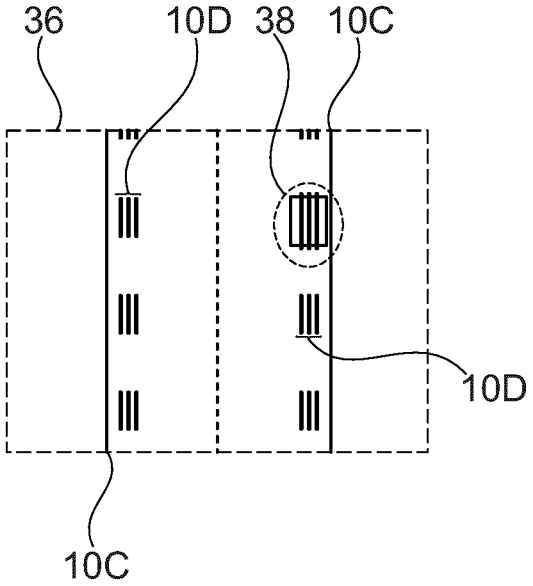
FIGS. 8A and 8B show two different combined 2-dimensional visual surface images of two different aerosol-generating particles with manufacturing defects.
Figure 8B:
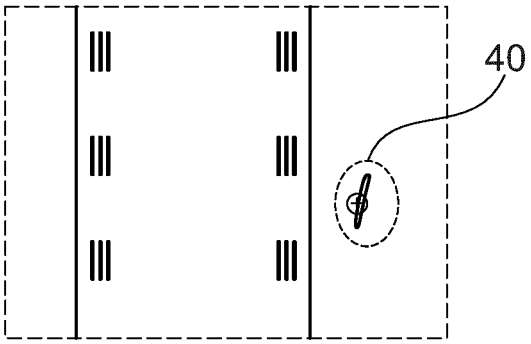

FIGS. 8A and 8B show different combined 2-dimensional visual surface images of double sticks with manufacturing defects. Such a grayscale surface image can be obtained by combining various different grayscale intensity lines, recorded at different rotation angles of the aerosol-generating article. In FIG. 8A the set of second visual markers 10D are not straight, but wavy as shown in the circles denoted with 38 probably due to dislocation of the tipping paper in this region. In FIG. 8B a stain 40 is present as a manufacturing defect. In both cases, the visual imaging of the double stick is well able to detect both manufacturing defects.

The invention claimed is:

1. A method for checking an aerosol-generating article for manufacturing defects, comprising:

recording several 2-dimensional surface profiles of the aerosol-generating article while rotating the aerosol-generating article, combining several surface profiles recorded at different rotation angles to obtain a 3-dimensional surface profile, calculating a maximum height difference of the 3-dimensional surface profile, and rejecting the aerosol-generating article if the maximum height difference of its 3-dimensional surface profile is above a threshold value, wherein additionally a 2-dimensional visual image of the surface of the aerosol-generating article is recorded while rotating the aerosol-generating article several 2-dimensional surface visual images or intensity lines recorded at different rotation angles are combined to obtain a combined 2-dimensional visual surface image, the combined visual surface image is compared with a combined defect-free visual image of a defect-free aerosol-generating article via image-correlation, and the aerosol-generating article is rejected if its combined visual surface image does not fit the defect-free visual image.

2. The according to claim 1, wherein the aerosol-generating article comprises a filter portion and a substrate portion, the substrate portion comprising aerosol-forming substrate, further wherein the aerosol-generating article comprises a tipping paper overwrapping the filter portion and at least a part of the substrate portion is adjacent to the filter portion.

3. The method according to claim 2, wherein several 2-dimensional surface profiles of at least the filter portion and parts of the substrate portion overwrapped by the tipping paper are recorded.

4. The method according to claim 1, wherein the manufacturing defects are selected from a group consisting of tears, slits, holes, wrinkles, breaking, faulty adhesion of filter portion to substrate portion, and exposed connection between filter portion and substrate portion.

5. The method according to claim 1, wherein at least one visual marker is present on the surface of the aerosol-generating article and wherein the position of the visual marker on the surface of the aerosol-generating article is determined using the combined 2-dimensional visual surface image, preferably wherein the visual marker comprises at least one line.

6. The method according to claim 1, wherein the manufacturing defects are selected from a group consisting of stains, displacement of the tipping paper relative to the substrate portion, mixing of different brands of aerosol-generating articles and folding of the tipping paper.

7. The method according to claim 1, wherein the aerosol-generating article is rotated 360 degrees and wherein one or both:

a 360 degrees 3-dimensional surface profile, or a 360 degrees combined 2-dimensional visual surface image are obtained.

8. The method according to claim 1, wherein a line laser sensor is employed for recording one or both of:

the several 2-dimensional surface profiles, or the several 2-dimensional surface visual images.

9. An inspection device configured for detection of manufacturing defects in aerosol-generating articles, comprising:

a surface profile sensor configured for recording several 2-dimensional surface profiles of the aerosol-generating article, rotating means configured for rotating the aerosol-generating article during the recording of the surface profiles, and a surface profile controller configured for processing the several 2-dimensional surface profiles recorded at different rotation angles to obtain a 3-dimensional surface profile, and configured for calculating a maximum height difference of the 3-dimensional surface profile, further comprising:

a visual imaging sensor configured for recording several 2-dimensional visual images or intensity lines of the surface of the aerosol-generating article while rotating the aerosol-generating article, and a visual imaging controller configured for processing the several 2-dimensional surface visual images or intensity lines at different rotation angles to obtain a combined 2-dimensional visual surface image and configured for comparing the combined visual surface image with a combined defect-free visual image of a defect-free aerosol-generating article via image-correlation.

10. The inspection device according to claim 9, wherein the visual imaging sensor and the surface profile sensor are integrated in one single sensor head, preferably wherein the sensor head is a line laser sensor head.

11. The inspection device according to claim 9, wherein the surface profile controller and the visual imaging controller are integrated into one single control unit.

12. The inspection device according to claim 9, wherein the rotating means comprises either:

two rotating drums, one rotating drum and one stationary part, one moving belt and one stationary part.

13. The inspection device according to claim 9, and an aerosol-generating article.

* * * * *